US011510481B2

(12) United States Patent
Seidel

(10) Patent No.: US 11,510,481 B2
(45) Date of Patent: Nov. 29, 2022

(54) ADAPTABLE HAMMOCK SHELTER

(71) Applicant: Daniel Seidel, Columbia, MO (US)

(72) Inventor: Daniel Seidel, Columbia, MO (US)

( * ) Notice: Subject to any disclaimer, the term of this patent is extended or adjusted under 35 U.S.C. 154(b) by 898 days.

(21) Appl. No.: 16/318,291

(22) PCT Filed: Jul. 17, 2017

(86) PCT No.: PCT/US2017/042407
§ 371 (c)(1),
(2) Date: Jan. 16, 2019

(87) PCT Pub. No.: WO2018/017486
PCT Pub. Date: Jan. 25, 2018

(65) Prior Publication Data

US 2019/0231055 A1 Aug. 1, 2019

Related U.S. Application Data

(60) Provisional application No. 62/493,777, filed on Jul. 16, 2016.

(51) Int. Cl.
*A45F 3/22* (2006.01)
*A45F 3/52* (2006.01)

(52) U.S. Cl.
CPC . *A45F 3/22* (2013.01); *A45F 3/52* (2013.01)

(58) Field of Classification Search
CPC ..... A45F 3/22; A45F 3/52
See application file for complete search history.

(56) References Cited

U.S. PATENT DOCUMENTS 759,240 A * 5/1904 Conway ..... A45F 3/22 5/122
6,421,851 B2 * 7/2002 Hennessy ..... A45F 3/22 5/120
2013/0038096 A1 2/2013 Newsome

OTHER PUBLICATIONS

International Search Report and Written Opinion received for PCT/US2017/042407, dated Sep. 28, 2017.

* cited by examiner

*Primary Examiner* — Fredrick C Conley
(74) *Attorney, Agent, or Firm* — Greer, Burns & Crain, Ltd

(57) ABSTRACT

An exemplary hammock shelter may provide unique ergonomic features, such as slits and pockets that permit a user's arms and legs to hang below the hammock. This arrangement of features may advantageously provide the user a flatter posture with improved comfort and ergonomic support. An exemplary hammock shelter may be used alone or multiple sheet or blanket accessories may be attached to provide insulation and comfort to the user over a range of temperatures. In some examples, insect and weather barrier canopies may be attached or otherwise affixed to an exemplary hammock structure to provide protection to the user from insects and weather elements.

12 Claims, 16 Drawing Sheets

ADAPTABLE HAMMOCK SHELTER

CROSS-REFERENCE TO RELATED APPLICATION

This application claims the benefit of U.S. Provisional Application 62/493,777, filed Jul. 16, 2016.

TECHNICAL FIELD

The present disclosure relates generally to one or more methods, systems, and/or apparatuses for an adaptable hammock shelter with unique canopy and ergonomic elements and features.

BACKGROUND

The desirability of a hammock shelter has been realized before, e.g., the advantages of sleeping off of the ground, less gear, light weight sleep system, and fast set up. However, designing a hammock shelter presents significant challenges that have limited the success of hammock shelters on the market. Opportunity exists for a versatile adaptable hammock shelter that overcomes the common design problems.

SUMMARY DISCLOSURE OF INVENTION

The following presents a simplified summary in order to provide a basic understanding of some aspects of the invention. This summary is not an extensive overview. It is not intended to identify key or critical elements of the invention or to delineate the scope of the invention. The following summary merely presents some concepts of the invention in a simplified form as a prelude to the more detailed description provided below.

Aspects of the present invention relate to an adaptable hammock shelter with unique ergonomic features, and accessory attachments to adapt the hammock to various climates and conditions. According to aspects of the present invention, an exemplary hammock shelter may provide unique ergonomic features, such as slits and pockets that permit a user's arms and legs to hang below the hammock. This arrangement of features may advantageously provide the user a flatter posture, with improved comfort, and ergonomic support. An exemplary hammock shelter may be used alone or multiple sheet or blanket accessories may be attached to provide insulation and comfort to the user over a range of temperatures. In some examples, insect and weather barrier canopies may be attached or otherwise affixed to an exemplary hammock structure to provide protection to the user from insects and weather elements. As demonstrated below, one or more exemplary canopies may incorporate a unique closure system that is operated by, among other things, a draw strap.

Figure 1:
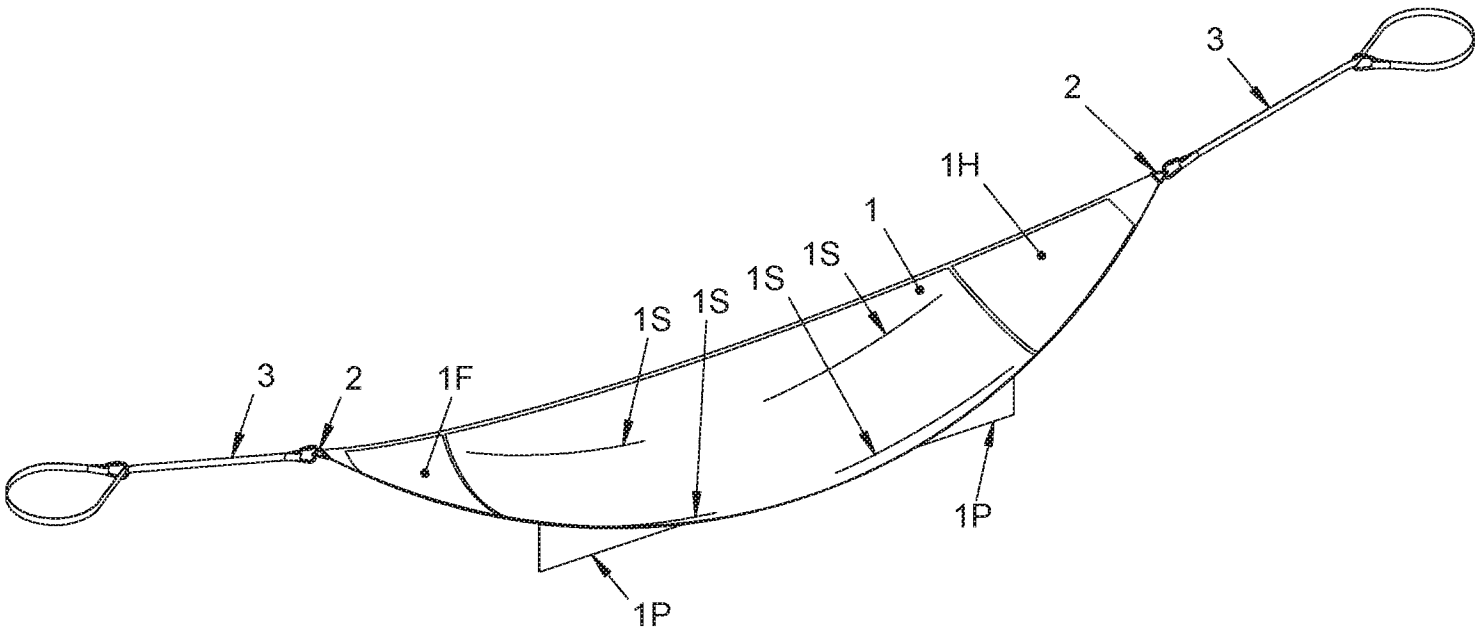
FIG. 1 is perspective view of an exemplary hammock with support straps, according to various aspects described herein.

According to aspects of the present invention and by way of demonstration and not limitation, an exemplary embodiment (e.g., as illustrated in the FIGURES) may include one or more of the following elements: 1H Hammock Head End; 1F Hammock Foot End; 1S Slit; 1P Pocket; 2 V-Ring; 3 Anchor Strap Clip; 5 Separating Zippers; 6 Lower Blanket; 7 Upper Blanket; 8 Taut Strap; 9 Link; 10A Pulley Link; 10B Pulley Link; 10C Pulley Link; 11 Canopy Pull Strap; 12 Canopy Zipper; 14 Canopy Zipper Slider; 15 Canopy; 15H Canopy Head End; 15F Canopy Foot End; 16 Scroll Fold. The reference characters are more fully described below.

DETAILED DESCRIPTION

In the following description of the various embodiments, reference is made to the accompanying drawings, which form a part hereof, and in which is shown by way of illustration various embodiments in which features may be practiced. It is to be understood that other embodiments may be utilized and structural and functional modifications may be made.

In FIG. 1, an exemplary hammock 1 is demonstrated. By way of demonstration and not limitation, the hammock 1 may be made of durable fabric or netting. Each end of the hammock 1 material is attached to a v-ring 2 or d-ring or other suitable piece of hardware. At each end of the hammock 1, an anchor rope or anchor strap 3 is attached to the v-ring 2 and to a tree or other support structure or element to suspend the hammock 1 in a generally horizontal matter between the two supports.

One major drawback to current hammocks is that the curvature of the hammock causes a few ergonomic discomforts. Current hammocks, when occupied by a user in a supine position, tend to support mainly the heels of the user and generally provide little to no support to the back of the user's knees. The curvature of current hammocks may also cause the shoulders of the user to be drawn inward ("shoulder squeeze"). Accordingly, hammock 1 of the present invention may have slits 1S in the hammock 1. The slits 1S advantageously allow the user's arms and lower legs to pass through the hammock support fabric into pockets 1P below the hammock 1. As a result, the posture of the user will be closer to flat, the back of the user's knees will be supported, and shoulder squeeze is effectively eliminated. The slits 1S and pockets 1P thereby advantageously improve comfort and ergonomic support.

Figure 2:
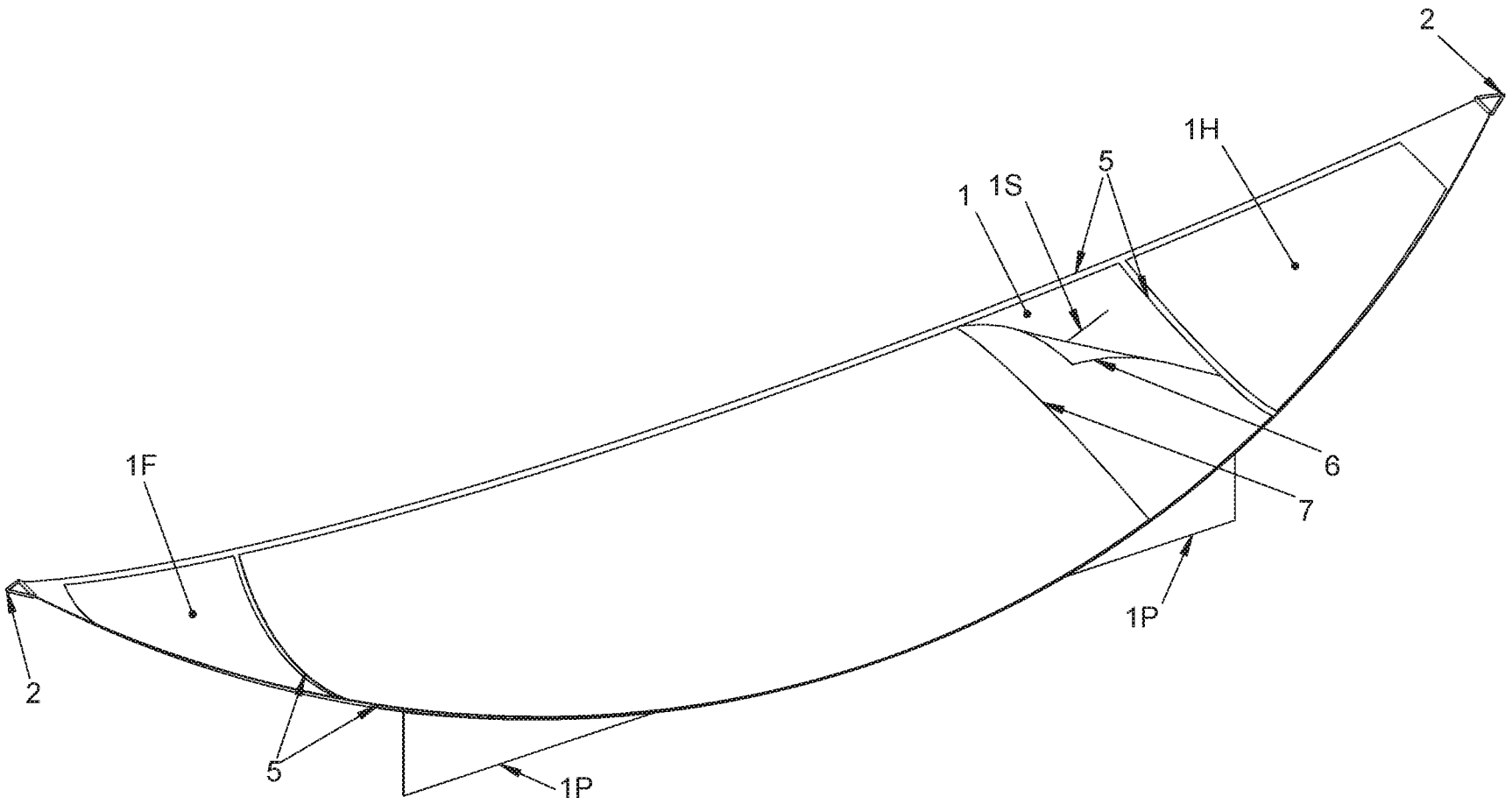
FIG. 2 is perspective view of an exemplary hammock with the lower blanket and upper blanket, according to various aspects described herein.
Figure 3:
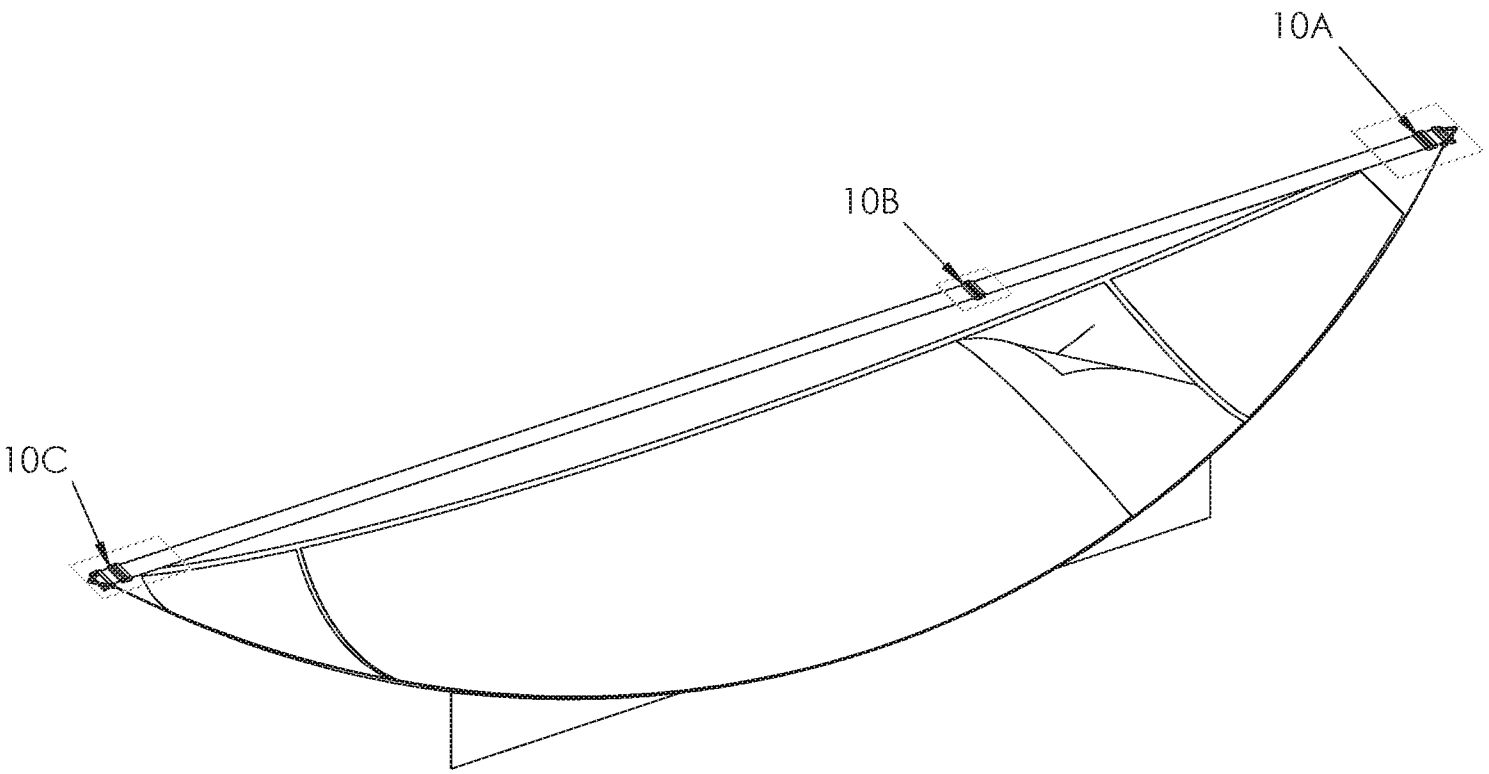
FIG. 3 is perspective view of an exemplary hammock, according to various aspects described herein.
Figure 4:
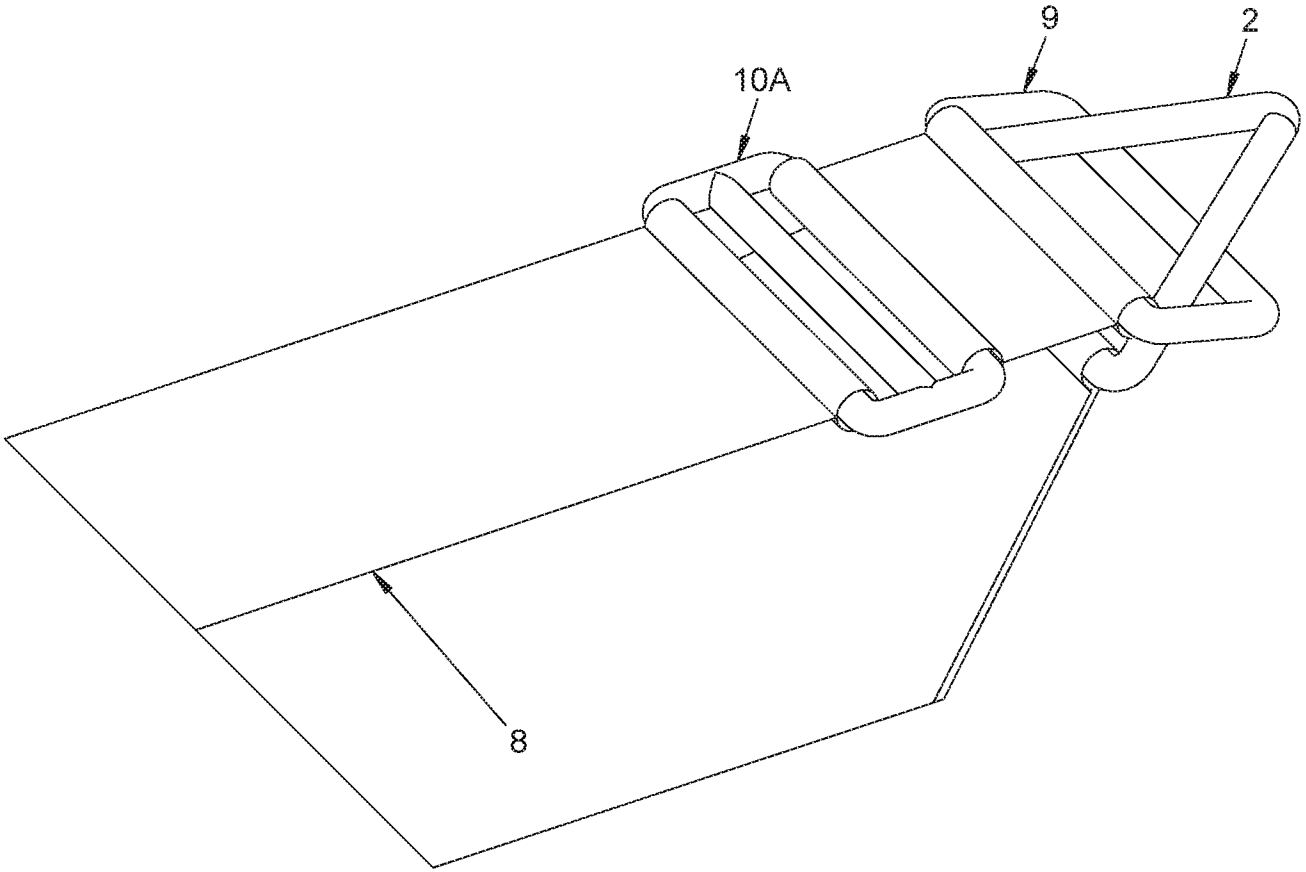
FIG. 4 is a perspective detail view of the taut strap in FIG. 3, according to various aspects described herein.
Figure 5:
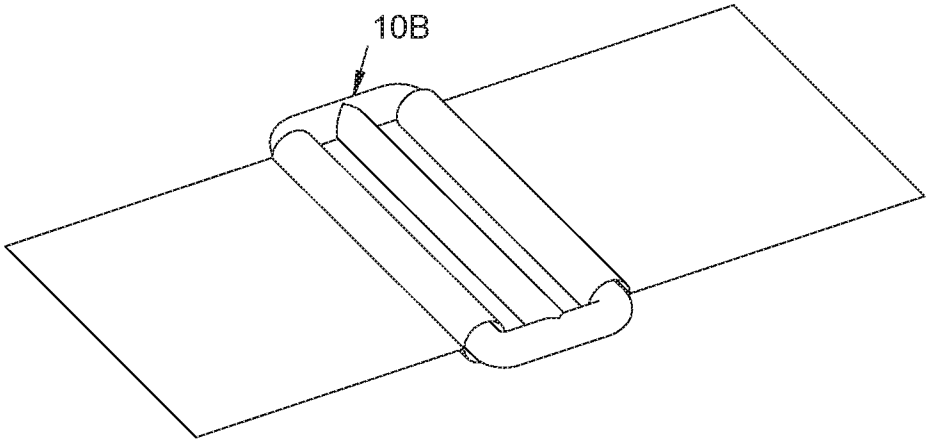
FIG. 5 is another perspective detail view of the taut strap in FIG. 3, according to various aspects described herein.
Figure 6:
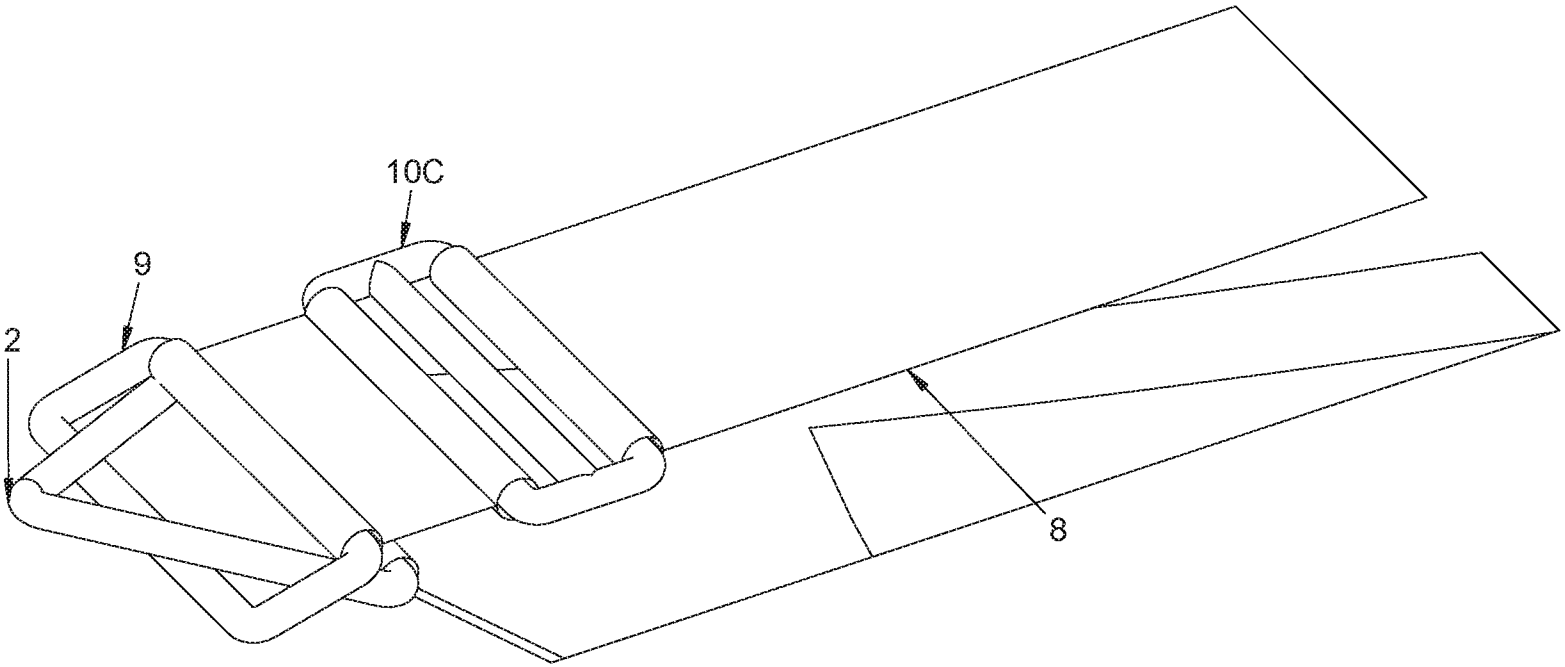
FIG. 6 is another perspective detail view of the taut strap in FIG. 3, according to various aspects described herein.
Figure 7:
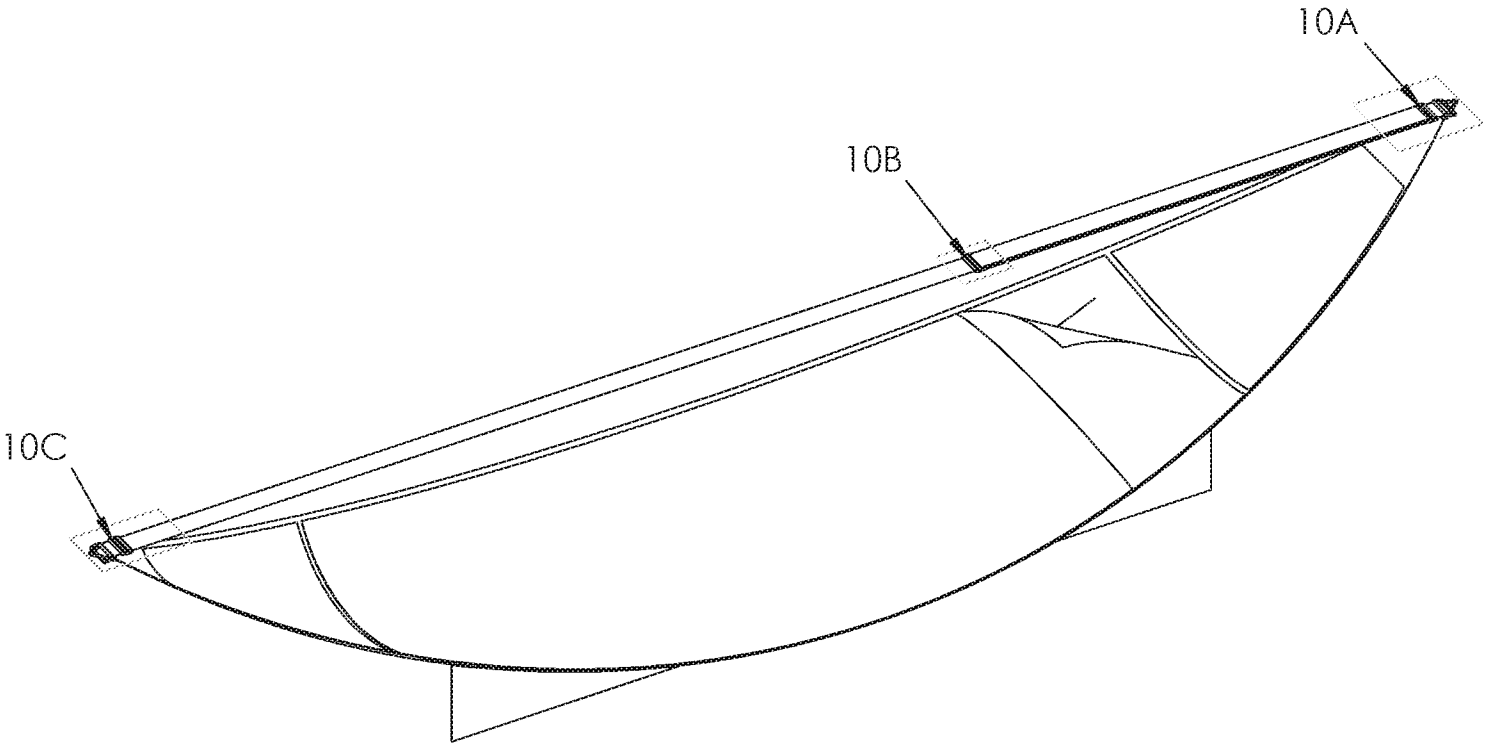
FIG. 7 is perspective view of aspects of the hammock, according to various aspects described herein.
Figure 8:
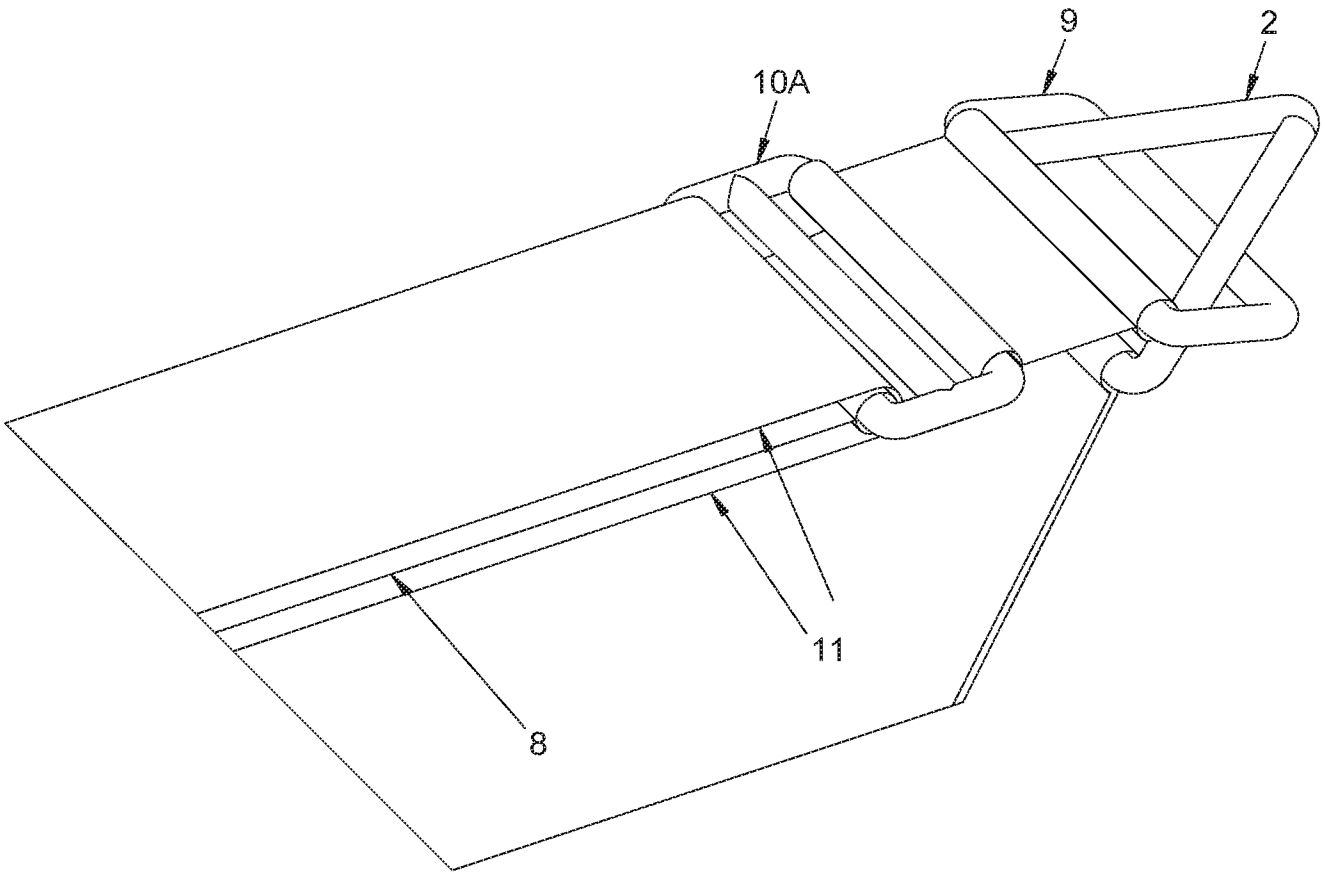
FIG. 8 is a perspective detail view G of an exemplary taut strap for an exemplary tension closure canopy, according to various aspects described herein.
Figure 9:
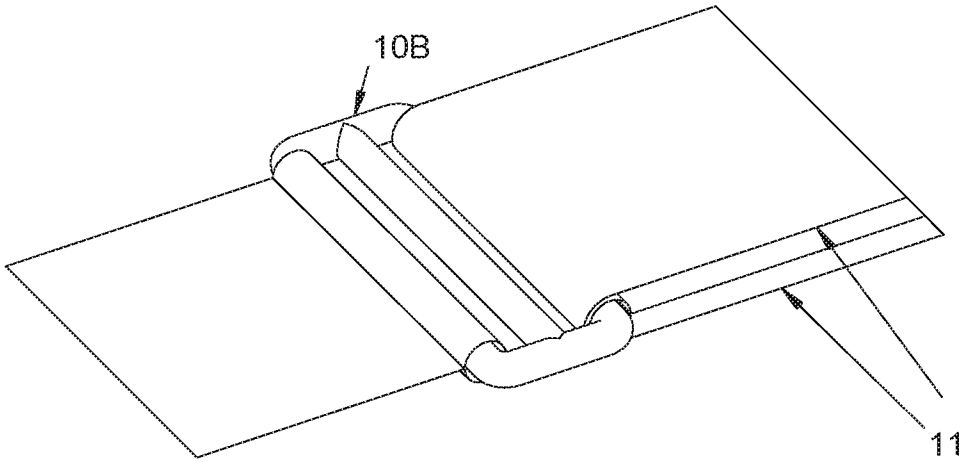
FIG. 9 is a perspective detail view H of an exemplary taut strap for an exemplary tension closure canopy, according to various aspects described herein.
Figure 10:
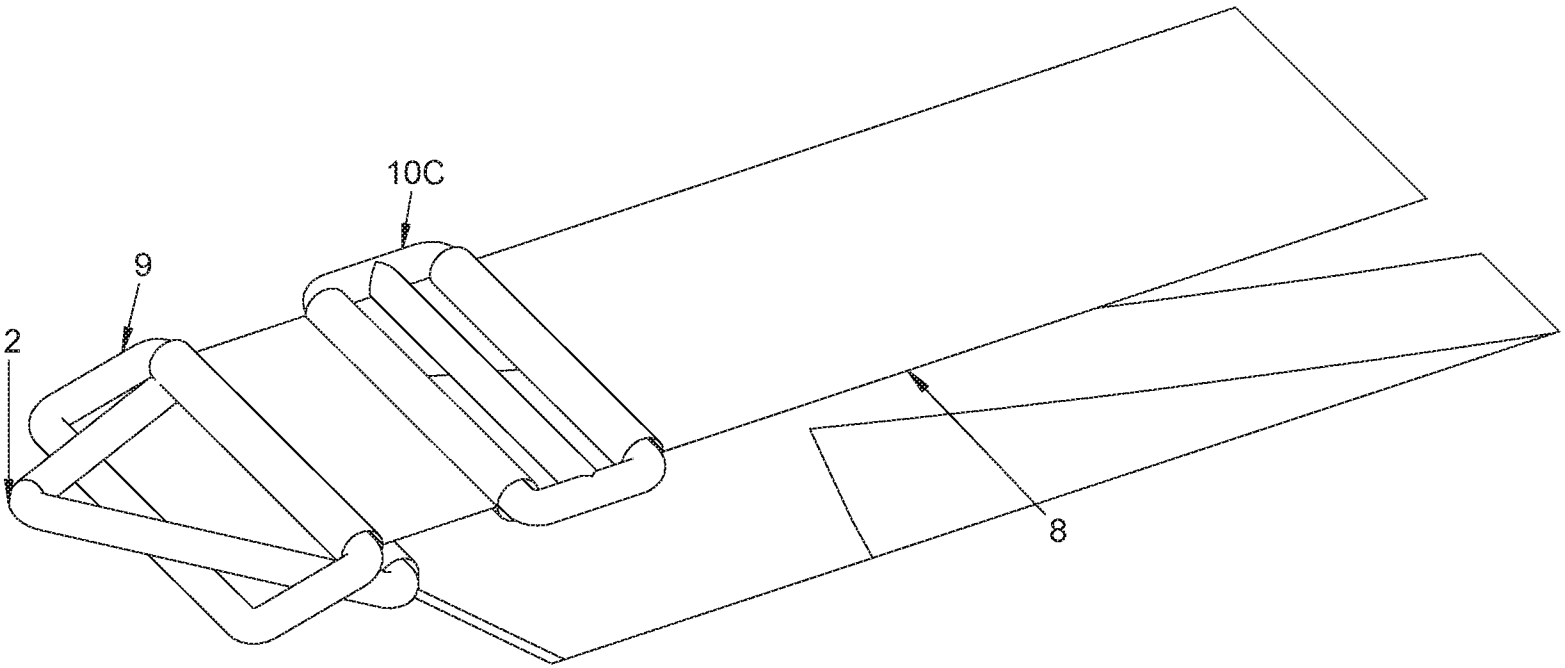
FIG. 10 is a perspective detail view I of an exemplary taut strap for an exemplary tension closure canopy, according to various aspects described herein.
Figure 11:
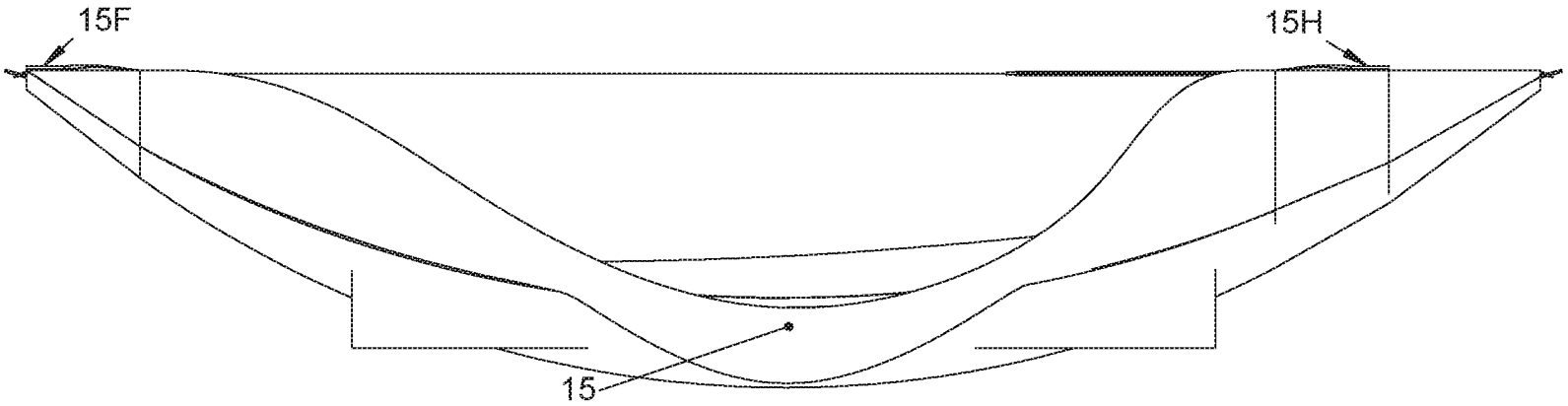
FIG. 11 is a side view of an exemplary hammock with an exemplary tension closure canopy, according to various aspects described herein.
Figure 12:
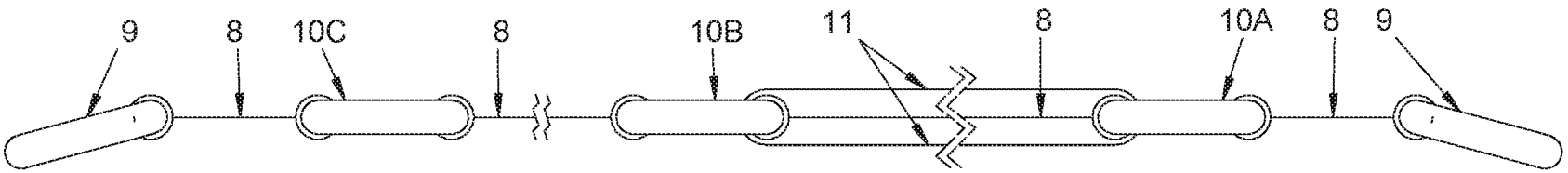
FIG. 12 is a shortened side view of an exemplary taut strap for an exemplary tension closure canopy, according to various aspects described herein.
Figure 13:
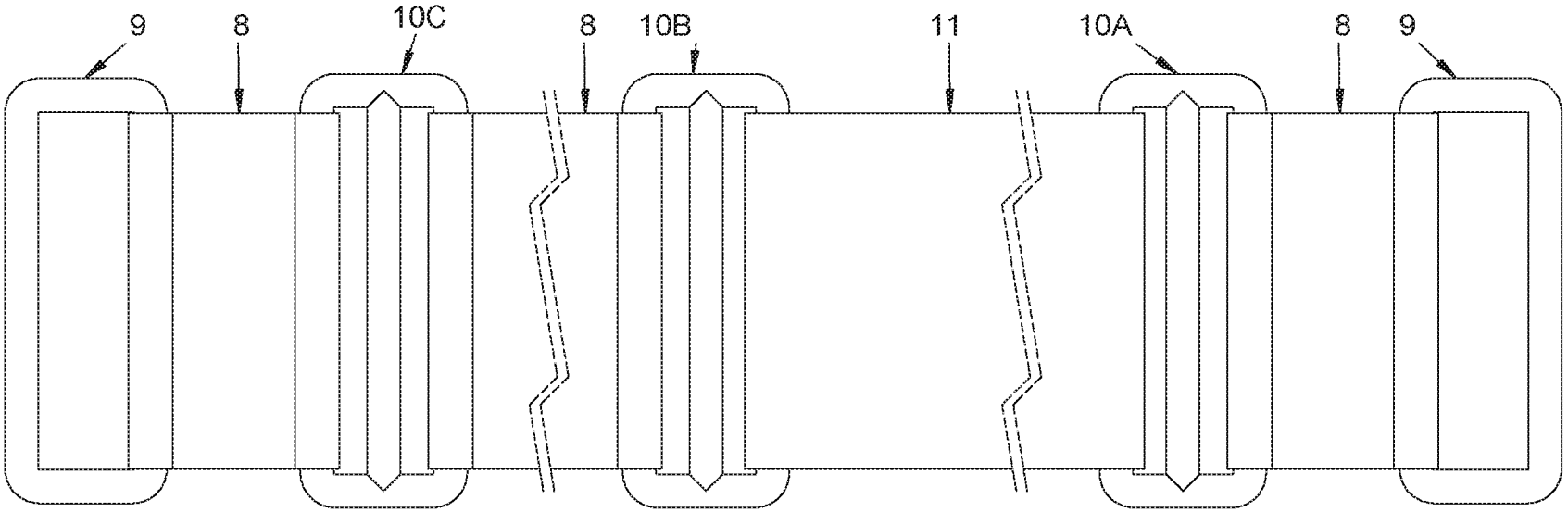
FIG. 13 is a shortened top view of an exemplary taut strap for an exemplary tension closure canopy, according to various aspects described herein.

Referring now to FIG. 2, one or more sets of separating fasteners 5 are sewn to the hammock 1. By way of demonstration and not limitation, FIG. 2 demonstrates the fasteners 5 as zippers. These separating zippers 5 allow accessories, such as insulative sheets and blankets, to be attached to the hammock 1 to provide the user with comfort over a range of temperatures. According to the example shown in FIG. 2, the lower blanket 6 may be positioned beneath the user and upper blanket 7 may be above the user. Furthermore, an insulative and/or heat reflective blanket (not illustrated) may be attached under the hammock 1. When blankets or sheets are attached to the hammock, they assume the same shape as the hammock. This allows easy entry and exit of the user from the hammock and blankets. This is a significant advantage over prior art that uses an unattached sleeping bag within the hammock. An unattached sleeping bag bunches together at the bottom of the hammock and makes entry and exit difficult. The easy entry and exit of the present system also presents a safety advantage.

Referring now to FIGS. 11,14,15,16, one or more accessory canopies 15 may be attached to the hammock 1 to enclose the hammock 1 and the user. For example, an insect barrier canopy, which may be made of a fine mesh material or other appropriate material, may be attached to protect the user from insects. In another example, a weather barrier canopy, which may be made of a water repellant material or other appropriate material, may be attached to protect the occupant from insects and weather elements. Additionally, a hybrid canopy, made of water repellant material or other appropriate material, having windows made of fine mesh material and closable window covers, may provide versatile protection to the user.

Turning now to FIGS. 3-6, if an accessory canopy 15 is to be used, a taut strap 8 may be attached to the hammock 1. The tip of the v-ring 2 (or other appropriate structure) at each end of the hammock 1 may be passed through a hardware link 9 (or other appropriate structure) at each end of the taut strap 8. The link 9 may be of a geometry that the v-ring 2 cannot pass completely through the link 9. According to the examples shown, one or more pulley-type links (10A,10B,10C) may be fixed between sections of the exemplary taut strap 8. In these example, the taut strap 8 may be shorter in length than the hammock 1, which thereby limits the distance between the v-rings 2 of the hammock 1. Therefore, the hammock 1 will consistently hang below the taut strap 8 with the same curvature when set up.

Figure 14:
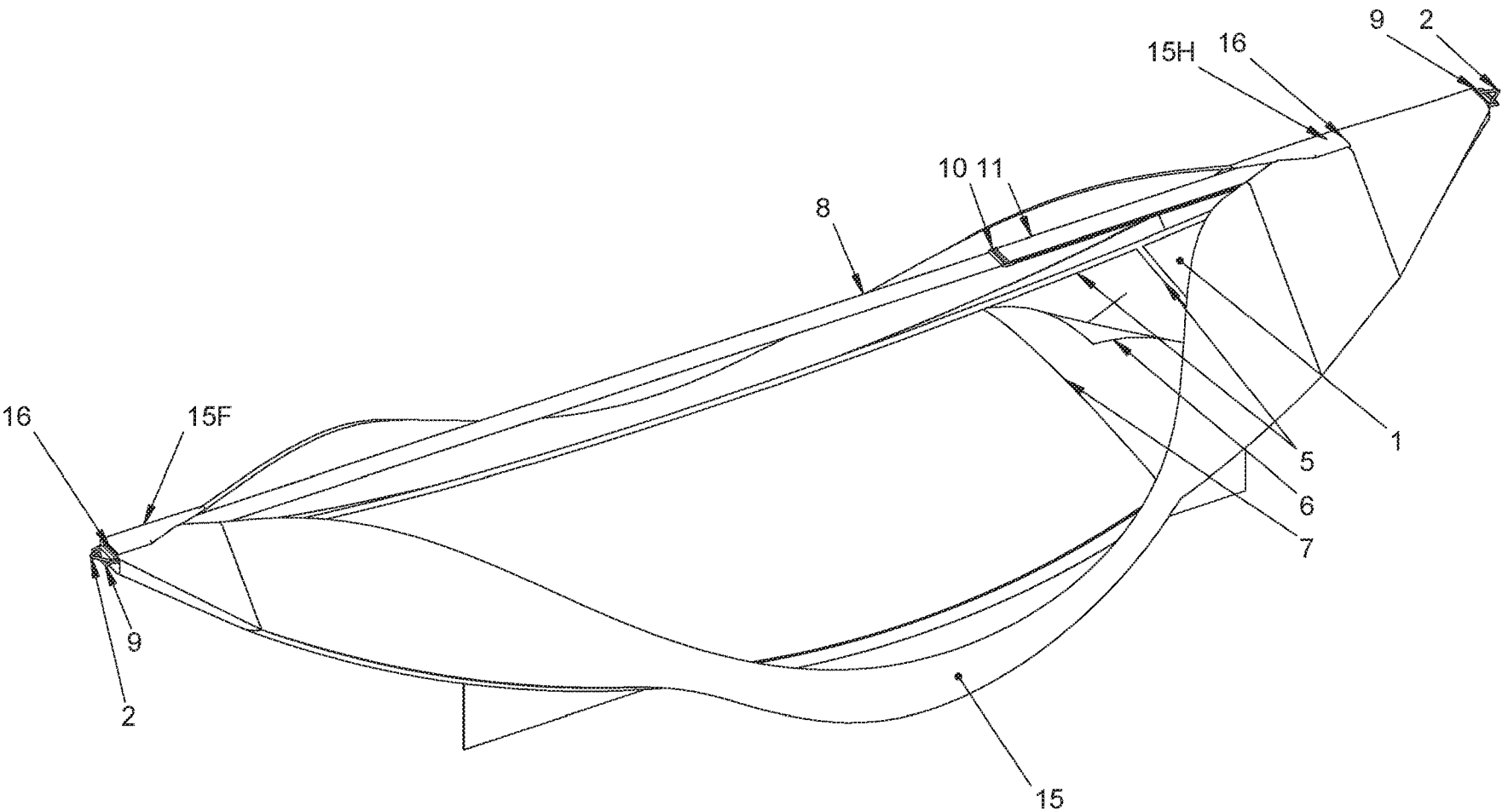
FIG. 14 is a perspective view of an exemplary hammock with an exemplary tension closure canopy open, according to various aspects described herein.
Figure 15:
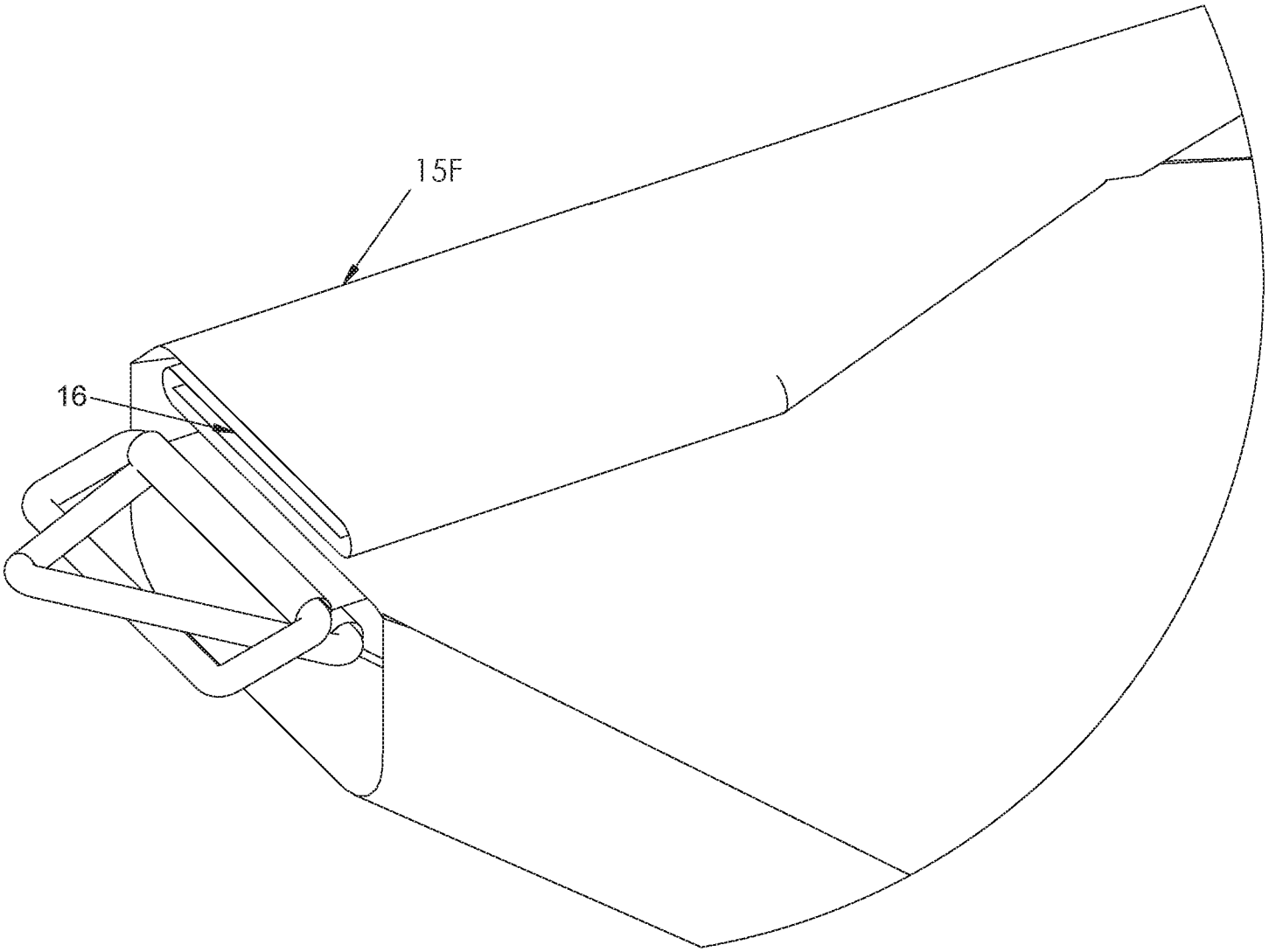
FIG. 15 is a perspective detail view J of an exemplary scroll fold at the foot end of an exemplary canopy, according to various aspects described herein.
Figure 16:
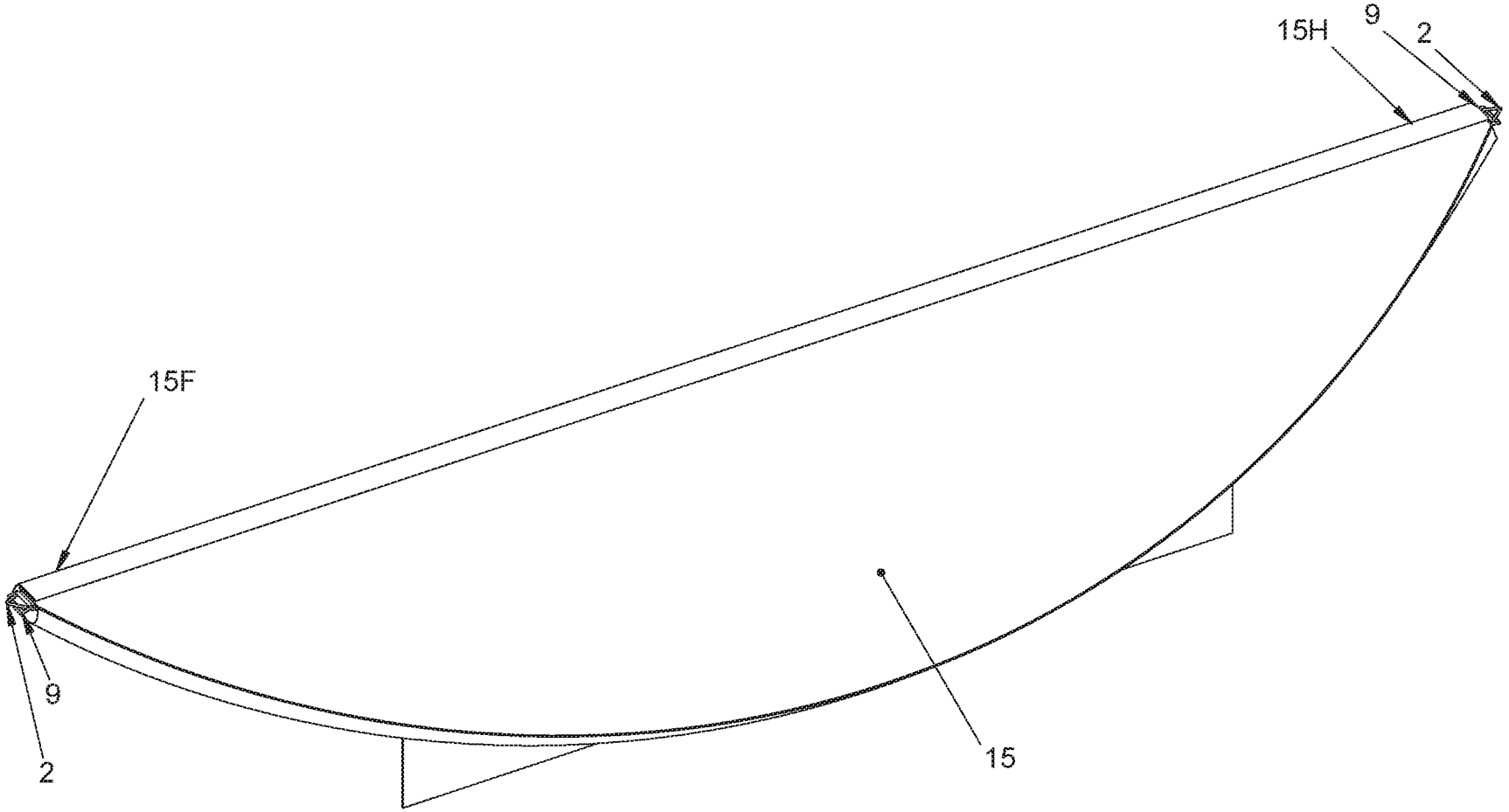
FIG. 16 is a perspective view of an exemplary hammock with an exemplary tension closure canopy closed, according to various aspects described herein.

According to the examples shown in FIGS. 14-16, the upper edges of the canopy 15 may be joined to each other in a scroll fold 16 at the canopy head end 15H and the canopy foot end 15F. FIG. 15 illustrates the scroll fold 16 at the canopy foot end 15F, in the form of a flattened scroll-type fold. The canopy foot end 15F may be sewn to the taut strap 8. The canopy head end 15H may be free to slide along the upper side of the taut strap 8. In FIGS. 7-14, an exemplary canopy pull strap 11 forms a loop around pulley links 10A and 10B. The canopy head end 15H may be fixed to the upper face of the canopy pull strap 11. Referring now to FIGS. 14-16, in the open configuration (FIG. 14), the upper edges of the canopy 15 may be parted and hanging slack along the sides of the hammock 1. To close the canopy 15, the user, while lying supine in the hammock 1, may pull the underside of the canopy pull strap 11 toward the hammock foot end 1F. This movement, by pulley action through the pulley links 10A and 10B, may cause the canopy head end 15H to slide toward the hammock head end 1H. As the canopy head end 15H moves away from the canopy foot end 15F, the resulting tension may draw the upper edges of the canopy 15 together into the same scroll fold as the canopy ends 15H and 15F. The closed canopy encloses the hammock 1 and user, and forms a peak above the taut strap 8. Scroll folds 16 at each of the canopy foot end 15F and canopy head end 15H may have enough turns to inhibit insect/water intrusion. The closure system described above provides for rapid and easy opening of the canopy with, with no need for a user to sit up and wrestle with lengthy zippers in the dark. This ease of opening therefore presents a significant safety advantage over current hammock shelter systems.

In summary, aspects of the present invention relate to an adaptable hammock shelter with unique ergonomic features, and accessory attachments to adapt the hammock to various climates and conditions. One of ordinary skill in the pertinent arts will recognize that, while various aspects of the present invention are illustrated in the FIGURES as separate elements, one or more of the elements may be combined, merged, omitted, or otherwise modified without departing from the scope of the present invention.

What is claimed is:

1. A hammock system comprising:

a bed for supporting a user, the bed having first and second bed ends;

an anchoring rope or strap at the end of the first and second bed ends for suspending the bed between two supports, the first and second bed ends being connected to the respective rope or strap; and a canopy having:

a taut strap that is interconnected at its opposing ends to one of the bed, and the anchoring ropes or straps, the taut strap being arranged to extend longitudinally between the first and second bed ends and having a length that is less than the maximum length of the bed between the first and second bed ends; and canopy material that has two upper edges that are joined together at first and second canopy ends, the first canopy end being connected to the taut strap; and the second canopy end being slidable along an upper side of the taut strap between:

a first position in which the upper edges of the canopy between the first and second ends canopy may be parted so as to be slack and partly adjacent respective lateral sides of the bed; and a second position in which tension in the canopy material between the first and second canopy ends causes the upper edges of the canopy material to be drawn together such that the canopy adopts a closed configuration in which the user is enclosed between the bed and the canopy material.

2. The hammock system of claim 1, wherein the canopy further comprises a pull strap that is moveable relative to the taut strap, wherein the second canopy end is secured to the pull strap, such that the second canopy end is moveable towards the second position by a pulling action on the pull strap in a first direction.

3. The hammock system of claim 2, wherein the pull strap is supported by the taut strap.

4. The hammock system of claim 3, wherein the taut strap includes pulley links between the opposing ends, and the pull strap forms a continuous loop around the pulley links.

5. The hammock system of claim 1, wherein the canopy is in the closed configuration, the canopy material forms a peak above the taut strap.

6. The hammock system of claim 1, wherein the upper edges of the canopy material at each of the first and second canopy ends is arranged into a scroll fold.

7. The hammock system of claim 6, wherein the second canopy end is in the second position, sufficient tension in the canopy material between the first and second canopy ends causes the upper edges of the canopy material between the first and second canopy ends to assume a scroll fold.

8. The hammock system of claim 7, wherein the scroll fold has sufficient turns to inhibit intrusion of at least one of insects, and water, into space that is enclosed between the bed and the canopy material.

9. The hammock system of claim 1, wherein the bed has therein at least a first opening and a second opening, the first opening and the second opening enabling a portion of a user's appendages to pass through the first and second openings from a top side of the bed.

10. The hammock system of claim 9, the system having a first pocket and a second pocket, wherein the first opening and the second opening enable a portion of a user's appendages to pass through the first and second openings from the top side of the bed into the first pocket and second pocket, respectively.

11. The hammock system of claim 9, the bed having disposed therein a third opening and a fourth opening, the third opening enabling a portion of a user's appendages to pass through the third and fourth openings from the top side of the bed.

12. The hammock system of claim 11, the system having a third pocket and a fourth pocket, wherein the first opening and the fourth opening enable a portion of the user's appendages to pass through the third and fourth openings from the top side of the bed into the third pocket and the fourth pocket, respectively.

* * * * *